United States Patent [19]

Siegelman

[11] 4,184,398

[45] Jan. 22, 1980

[54] SELF GENERATING ELECTRICAL PICKUP FOR MUSICAL INSTRUMENTS

[76] Inventor: Abe Siegelman, 9303 Major Ave., Morton Grove, Ill. 60053

[21] Appl. No.: 702,767

[22] Filed: Jul. 6, 1976

[51] Int. Cl.[2] ..... G10H 3/00; H01F 7/02

[52] U.S. Cl. ..... 84/1.15; 84/1.16; 335/302; 336/233

[58] Field of Search ..... 84/1.14–1.16, 84/402–405; 179/1 A, 1 M; 335/297, 302; 336/212, 233, 234

[56] References Cited

U.S. PATENT DOCUMENTS

| | | | |
|---|---|---|---|
| 2,317,164 | 4/1943 | Zimmerman | 84/403 |
| 2,933,967 | 4/1960 | Riscol | 84/1.16 |
| 3,249,677 | 5/1966 | Burns et al. | 84/1.15 |
| 3,257,586 | 6/1966 | Steingroever | 335/303 |
| 3,509,395 | 4/1970 | Schrencongost et al. | 84/1.15 |
| 3,649,737 | 3/1972 | Jespersen | 84/1.15 |
| 3,731,580 | 5/1973 | Suzuki | 84/430 |
| 3,826,171 | 7/1974 | Kaar | 84/297 S |
| 4,040,321 | 8/1977 | Lover | 179/1 M |
| 4,050,341 | 9/1977 | Underwood | 84/1.16 |

*Primary Examiner*—Edith S. Jackmon

[57] ABSTRACT

The following specification describes a self-generating electrical pickup to be applied to percussion type musical instruments with vibrating elements of steel or containing ferromagnetic material. The pickup is used in conjunction with an amplifier and loudspeaker to amplify the instrument sound. The pickup makes use of a plurality of pick off coils, one of each is used in proximity to each vibrating element of the musical instrument. Each pick off coil consists of a coil of many turns of fine wire within which is placed an iron core to which is bonded a ceramic permanent magnet. The large surface area of the ceramic magnet adjacent to the musical instrument vibrating element causes large magnetic flux changes in the coil and consequently a large signal voltage which is amplified to drive the loudspeaker. The large signal available, in this design, reduces the effect of 60 Hz hum induced by stray electromagnetic fields. The use of a ceramic magnet provides for a cost effective design. In this design, the plane surface of the ceramic magnet is placed in proximity to the surface of the vibrating element. The length of the iron core, to which the ceramic magnet is attached, exceeds the length of ceramic magnet and said longer iron core acts to extend the magnetic flux into the long solenoidal coil of copper wire, thus allowing for large induced electrical signals when the ceramic magnet surface is adjacent to the vibrating element.

9 Claims, 5 Drawing Figures

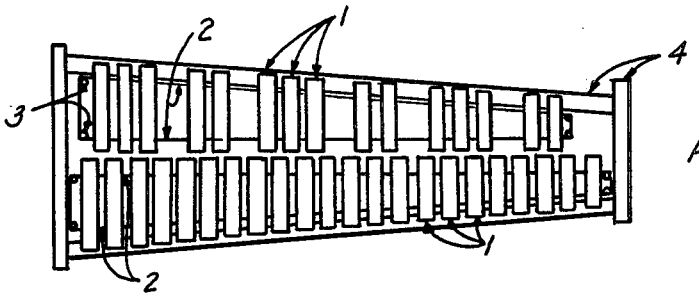
FIG. 1
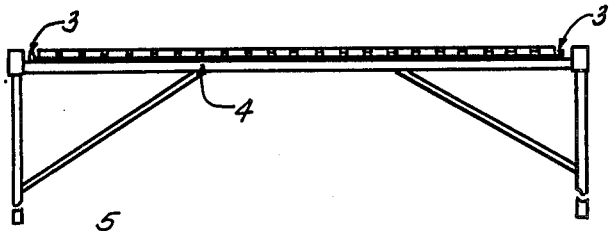
FIG. 2
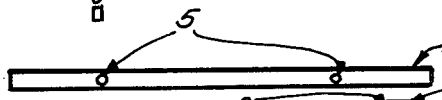
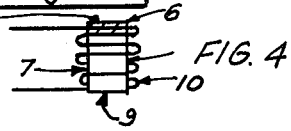
FIG. 4
FIG. 3
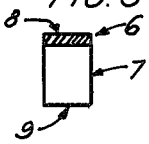
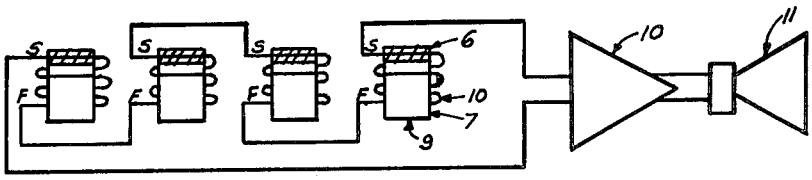
FIG. 5

SELF GENERATING ELECTRICAL PICKUP FOR MUSICAL INSTRUMENTS

This invention relates to means for electrical amplification of the tones from musical instruments and particularly instruments of the percussion type, such as the vibraphone or so called vibraharp, also referred to as vibes, as well as the marimba, xylophone and the like. Use is made of pickup coils wound with many turns of wire surrounding a magnet core. It is well known within the art that such pickup coils will generate an electrical signal which replicates the motion of the vibrating member when placed in close proximity to it. See for example Demuth U.S. Pat. No. 2,258,241, Fleury U.S. Pat. No. 2,510,094, Ayres U.S. Pat. No. 2,686,270, and Jesperson U.S. Pat. No. 3,649,737. The vibrating member in the case of a vibraharp, xylophone, marimba or the like are the tone bars which the player strikes with a hammer or mallet. The tone bars, if of metal, should contain a ferromagnetic material such as iron. Certain tone bars are made of iron, while others are made from aluminum or other metals which are alloyed with iron. When wooden or plastic tone bars or the like are used, the surface in proximity to the pickup coil may have attached to it adhesively an iron foil so that vibration of the bar alters the magnetic flux in accordance with its vibration. Alternatively the tone bars may be of wood or plastic with particles or fibers of iron or ferromagnetic material contained or dispersed within. The altering magnetic flux produces an electrical signal in the coil surrounding the magnetic core which is a replica of the motion of the tone bar. The pickup may be used with string instruments such as pianos, harps or the like, whose strings are struck with a hammer or plucked. The prior art used magnet cores using iron alloys and in particular alnico. The prior art magnet cores were comprised of a round rod whose length is many times the diameter, since alnico and the like exhibit a better magnetic strength for a high length to diameter ratio. A high length to diameter ratio is also convenient in that it provides for an adequate length of electrical coil surrounding the magnet core. Although magnets of rectangular cross section, whose length is long compared to any dimension in the cross section may be used, it is generally more convenient for iron alloy magnets such as alnico to have the cross section round. Such magnet cores have at least two serious limitations when applied to percussion instruments with tone bars having substantial surface area for pickup. One, since inherently the alnico magnet and the like likes to have a large length to diameter ratio, the area presented to the tone bar for pickup is limited for practical sizes and weights. Secondly, as one tries to increase the size of alnico magnets and the like, the cost of the magnet increases substantially. The present invention makes use of ceramic or barium ferrite magnets to overcome these objections. These ceramic magnets are polarized (or magnetized) along the thickness, that is along the short dimension, such that one surface, or face has a North pole and the opposite surface has a South pole. Ceramic or barium ferrite magnets, polarized as above, that is with one pole on each surface, develop their optimum magnetic strength when the thickness is short compared to the diameter. Used alone for a pickup, such a magnet presents a problem due to a lack of winding length for the surrounding coil. If a ceramic magnet alone is surrounded with a short or pancake style coil, and used for a pickup, it suffers from an inability to produce a good electrical signal because of the inadequate length of turns or excessive diameter of coil, which makes the magnetic flux changes in the coil not ideal when in proximity to the vibrating tone bar, that is, much of the flux returns from face to face of the magnet without being intercepted by the tone bar. To overcome this problem, this invention uses a ceramic magnet which is bonded to a long iron cylinder. This yields a core which has a short ceramic magnet but a long composite magnetic length and which has a diameter which can be made substantially larger than its alnico counterpart for much lower cost. The South pole of the ceramic magnet is shown bonded to the long iron core, however the performance is unimpaired if the North pole of the ceramic magnet is bonded to the iron core. Alternatively, composite cores of ceramic magnets and iron cores may be used, some with the South pole bonded to the iron core, and others with the North pole bonded to the iron core for the various tone bars without impairing the performance. Also, the diameter presented to the tone bar, and therefore magnetic area, is much larger allowing for a greater magnetic flux change in the surrounding coil and larger electrical signal output. The combination of the ceramic magnet bonded to the iron cylinder modifies the magnetic flux geometry so that more of the magnetic flux is available for interception by the tone bar and less returns from face to face of the ceramic magnet than would be the case if the ceramic magnet were to be used alone, that is without the bonded iron member. It is apparent that while this discussion relates to magnetic cores which are round, other shape cross sections may be used without departing from the spirit of the invention. It has been observed by direct measurement that the signal output of the pickup constructed according to this invention has greater signal output than a unit using a single iron magnet, rather than the composite ceramic magnet bonded to ordinary iron. Also, the tonal quality of the pickup using the composite magnetic core appears to be different and more pleasing to the ear. Since the area for magnetic flux interception by the tone bar and subsequently signal output is greater with the present invention other benefits follow. The pickup can be moved further from the surface of the tone bars making the problem of the tone bars impacting the pickup due to use of high striking force from the mallet less likely. Also, the signal to noise ratio in the presence of stray fields is enhanced. As indicated in the foregoing, the pickup consists of a composite magnetic core using a ceramic magnet, bonded to a longer iron core around which is wound many turns of fine wire. The wire is conventionally wound on the outside diameter of a coil form, often referred to as a spool or coil bobbin, inside of which is placed the composite core. The leads of the coil are connected to the input of an amplifier, which in turn is connected to a loudspeaker, so that when the vibrating element is struck or plucked, acoustic sounds replicating the motion of the vibrating element is heard. Usually, the musical instrument has a plurality of vibrating elements, and accordingly a number of pickups are used, which may be connected electrically in series or parallel or series parallel for further connection to the amplifier.

SUMMARY

Certain objects of this invention are to manufacture electrical pickups for percussion instruments and the like, having lower cost, higher signal output, less troubled by hum and microphonic noise, and can be placed further from the tone bars and other benefits.

FIG. 1 is a plan view of a vibraharp.

FIG. 2 is a side elevation view with the supporting legs broken away.

FIG. 3 illustrates a pickup coil in proximity to a tone bar, of which an end section is shown as viewed from 3—3 of FIG. 2.

FIG. 4 shows the pick coil magnetic core arrangement.

FIG. 5 is a schematic wiring diagram showing how the pickup coils are connected for amplification to drive a loudspeaker.

In FIGS. 1, 2 and 3 the tone bars, or vibrating elements, are illusrated by 10. A stringing arrangement 12 runs through two modal points in each tone bar and provides support for the tone bars in a manner to allow them to freely vibrate when struck with a mallet, as illustrated in FIG. 1.

The string is supported by means of pins placed in the structure frame 16. One pickup coil 22 is placed in proximity to each tone bar 10, as shown in FIG. 2. The pickup coil is wound with many turns of fine copper wire 26. Within the coil is a composite magnetic core consisting of an iron core 30 adhesively attached to a ceramic magnet 20, as is shown in FIGS. 3 and 4. The ceramic magnet is polarized along its thickness with one surface 38 being a North magnetic pole and its opposite surface 38' being a South magnetic pole. The pole face 38 of the composite core has its plane parallel to the plane of the tone bar 10 and is placed in a position of maximum tone bar vibration.

When the tone bar is in motion, the magnetic circuit reluctance varies producing a changing magnetic flux through coil 22 which results in a electrical signal appearing across coil terminals 36 which replicates the motion of the tone bar. The broken lines 40 in FIG. 3 illustrate the path for the magnetic flux. FIG. 5 shows one manner of electrical connection of a plurality of pickups 22 to an amplifier 42 and loudspeaker 44. At least one pickup would ordinarily be used for each tone bar or vibrating element of the musical instrument placed in proximity to the vibrating element. Shown in FIG. 5 is a series opposing electrical connection for adjacent pickup coils to provide for hum cancelling when the instrument is played in the vicinity of stray hum fields. The S in FIG. 5 refers to the start of the coil winding and the F to the finish. The prior art and the Demuth and Fleury patents teach various electrical connecting arrangements for pickup coil windings in combination with various arrangements for poling the magnet faces to minimize the effects of hum pickup in stray magnetic fields and accordingly these will not be dwelled on here, since it is apparent to anyone skilled in the art that these means of coil connecting and magnet poling may be employed here without departing from the spirit of the invention.

What we claim is:

1. A self generating pickup, for musical instruments of the percussion type having at least one vibrating element containing magnetic material, a composite magnetic core comprised of a ceramic magnet, over whose plane surface the magnetic flux is reasonably uniform, bonded to an iron structure of length exceeding the length of the ceramic magnet around which is wound many turns of conducting wire to form an electrical coil for connection to an amplifier and loudspeaker, said ceramic magnet polarized along its thickness with a North magnetic pole on one surface and a South magnetic pole on the opposite surface, said pickup being oriented so that the plane surface of the ceramic magnet is in proximity to and parallel to a surface of the vibrating element, said pickup magnetic core having a surface placed in proximity to and parallel to the surface of the vibrating element such that when such vibrating element is struck with a mallet the vibrations are set up in the vibrating element causing a magnetic flux change in the coil surrounding the magnetic core which causes an electrical signal to be generated in the coil which replicates the motion of the vibrating element.

2. The connection of the pickup as claimed in 1 with an amplifier and loudspeaker to produce acoustic sound replicating the electrical signal and the motion of the vibrating element of the musical instrument.

3. An arrangement as claimed in 1 where the vibrating elements are made of steel and arranged to be plucked.

4. An arrangement of a plurality of pickups as claimed in 1 with at least one pickup used for each vibrating element with a series connection of the pickup coils with connection to an electrical amplifier and speaker to produce acoustic sounds replicating the motion of the vibrating element of the musical instrument.

5. An arrangement of the pickup as claimed in 1 whereby the magnetic surface of the pickup is placed in proximity to more than one vibrating element of a musical instrument so that the magnetic flux change created through the pickup coil is dependent on the combined vibration effect of the elements in proximity to its surface so as to get an effect when the signal is amplified of the combination of the vibrating elements which are in proximity to the core of the pickup coil.

6. An arrangement of a plurality of pickups as claimed in 1 with at least one pickup used for each vibrating element, with the coils of the pickups all connected in parallel with electrical connection of each of the two parallel connected leads to an amplifier and speaker to produce acoustic sounds replicating the motion of the vibrating element of the musical instrument.

7. An arrangement as claimed in 4 with a plurality of pickup coils each of which have one or more vibrating elements of the musical instrument in proximity to their surface with the coils electrically connected in series and further connected to an amplifier and loudspeaker to produce sounds which acoustically replicate the motion of the vibrating elements.

8. An arrangement as claimed in 1 where the vibrating elements of the musical instrument are plastic but with an iron foil bonded to the surface and which bonded iron foil is arranged parallel to and in proximity to the magnetic surface of the pickup core so that when such vibrating element is struck with a mallet the vibrations produce an electrical signal which may be electrically amplified and connected to a loudspeaker so as to produce sound which replicates the motion of the vibrating element.

9. An arrangement as claimed in 1 where the vibrating elements of the musical instrument are plastic but with particles of ferromagnetic material dispersed within the vibrating elements and with the vibrating elements arranged parallel to and in proximity to the magnetic surface of the pickup core so that when such vibrating element is struck with a mallet the vibrations produce an electrical signal which may be electrically amplified and connected to a loudspeaker so as to produce sound which replicates the motion of the vibrating element.

* * * * *